US005199586A

United States Patent [19]

Pech et al.

[11] Patent Number: 5,199,586

[45] Date of Patent: Apr. 6, 1993

[54] QUICK-CONNECT SECTIONAL BOOM MEMBERS FOR CRANES AND THE LIKE

[75] Inventors: David J. Pech; Wayne W. Beebe, both of Manitowoc; Terry Casavant, Two Rivers; John Lanning, Cato; Paul M. Pukita, Manitowoc; Michael J. Wanek, Two Rivers, all of

[73] Assignee: The Manitowoc Company, Inc., Manitowoc, Wis.

[21] Appl. No.: 736,029

[22] Filed: Jul. 25, 1991

[51] Int. Cl.[5] ..... B66C 23/26; B66C 23/24; B66C 23/70; B66C 23; B66C 42

[52] U.S. Cl. ..... 212/175; 212/177; 212/176; 212/183; 212/187

[58] Field of Search ..... 403/335; 308/3 R; 212/175, 176, 177, 183, 185, 187, 188; 280/504, 508, 514, 515

[56] References Cited

U.S. PATENT DOCUMENTS

| | | | |
|---|---|---|---|
| 2,115,194 | 4/1938 | Burton | 287/103 |
| 2,649,210 | 8/1953 | Marchese | 212/144 |
| 2,809,756 | 10/1957 | Bannister | 212/59 |
| 3,080,068 | 3/1963 | Felkner | 212/144 |
| 3,085,695 | 4/1963 | Miller | 212/144 |
| 3,250,401 | 5/1966 | Davidson | 212/64 |
| 3,323,660 | 6/1967 | Allin, Sr. | 212/144 |
| 3,511,388 | 5/1970 | Markwardt | 212/144 |
| 4,148,531 | 4/1979 | Hornagold | 308/3 R |
| 4,496,262 | 1/1985 | Sangster | 403/335 |

FOREIGN PATENT DOCUMENTS

| | | |
|---|---|---|
| 74333 | 7/1970 | Fed. Rep. of Germany . |
| 3706301 | 10/1987 | Fed. Rep. of Germany . |
| 3842726 | 6/1990 | Fed. Rep. of Germany . |
| 1250050 | 11/1960 | France . |
| 1547958 | 10/1968 | France . |
| 90416 | 3/1959 | Netherlands . |
| 542713 | 2/1977 | U.S.S.R. . |

OTHER PUBLICATIONS

Brochure, Manitowoc 4100W, Published by Manitowoc Engineering Co., 1972.

Brochure, TC 3600 Quicklifter, Published by Mannesmann Demag Baumaschinen, undated.

Brochure, LS-368RH5 Hydraulic Power Crane, Published by Sumitomo, undated.

*Primary Examiner*—Joseph F. Peters, Jr.
*Assistant Examiner*—Kenneth Lee
*Attorney, Agent, or Firm*—Willian Brinks Olds Hofer Gilson & Lione

[57] ABSTRACT

A quick-connect system is disclosed for sectional boom members for cranes and the like. The sectional boom members comprise chords for carrying compressive loads, each chord terminating in an end configured to abut against an end of a chord of an adjacent sectional boom member. The quick-connect system comprises at least one easily alignable connector secured to the ends of at least one of the chords, the connector comprising a compressive load bearing surface intersected by the intersection of the vertical and horizontal neutral axes of the chord to which the connector is attached.

35 Claims, 8 Drawing Sheets

FIG. 3
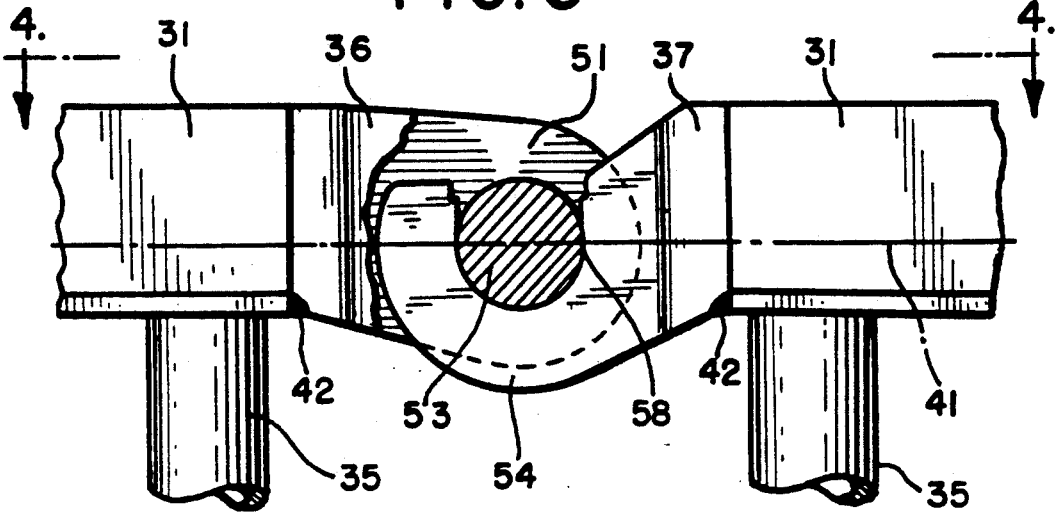
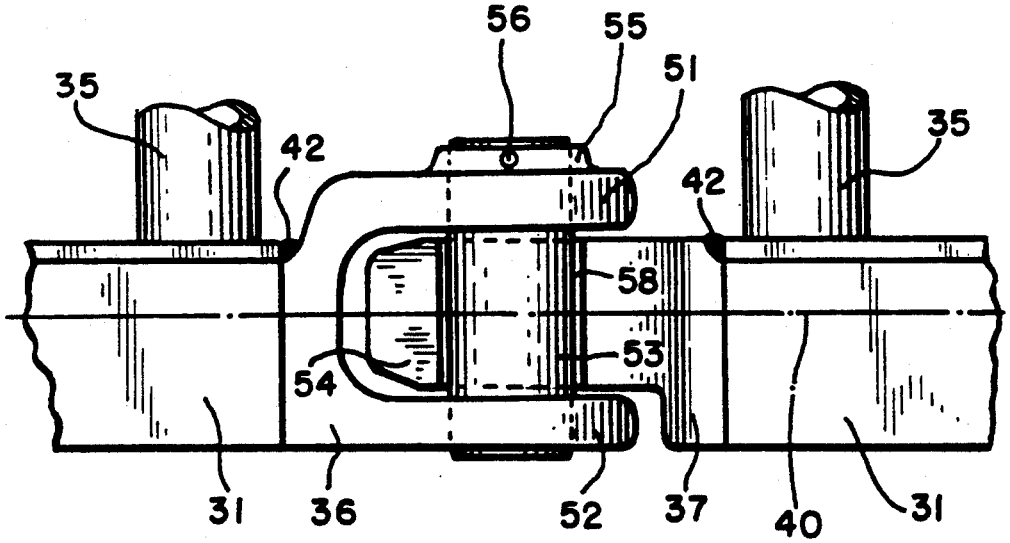
FIG. 4

FIG. 5
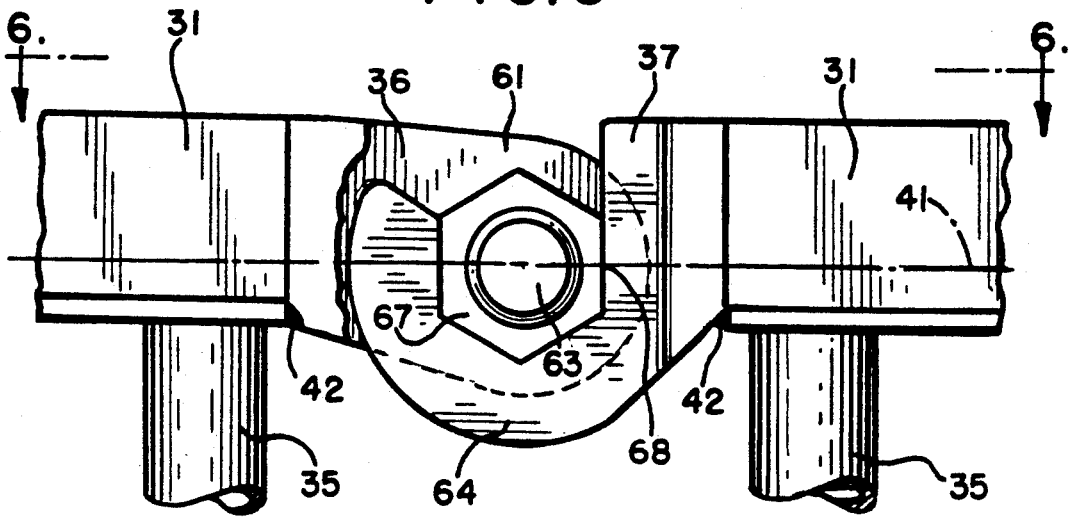
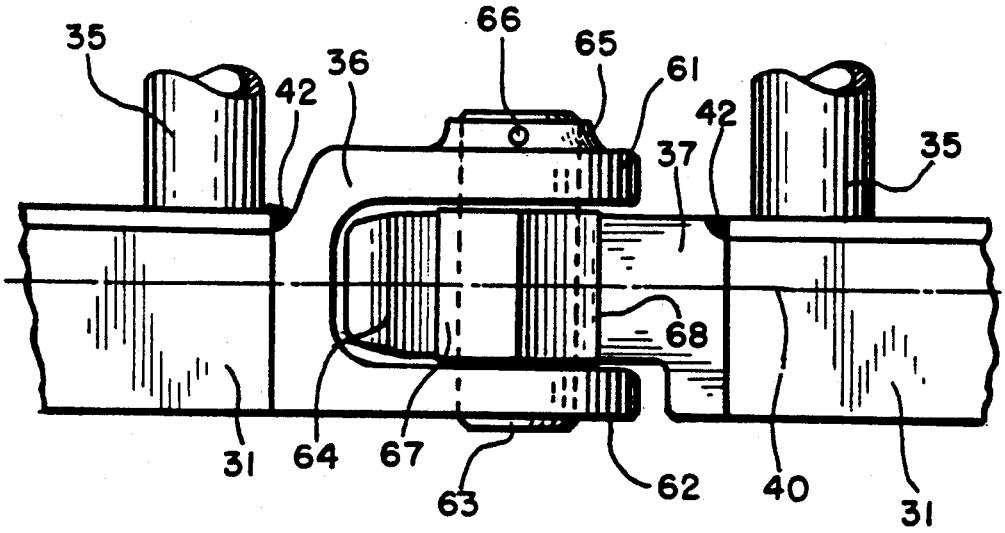
FIG. 6

FIG. 10
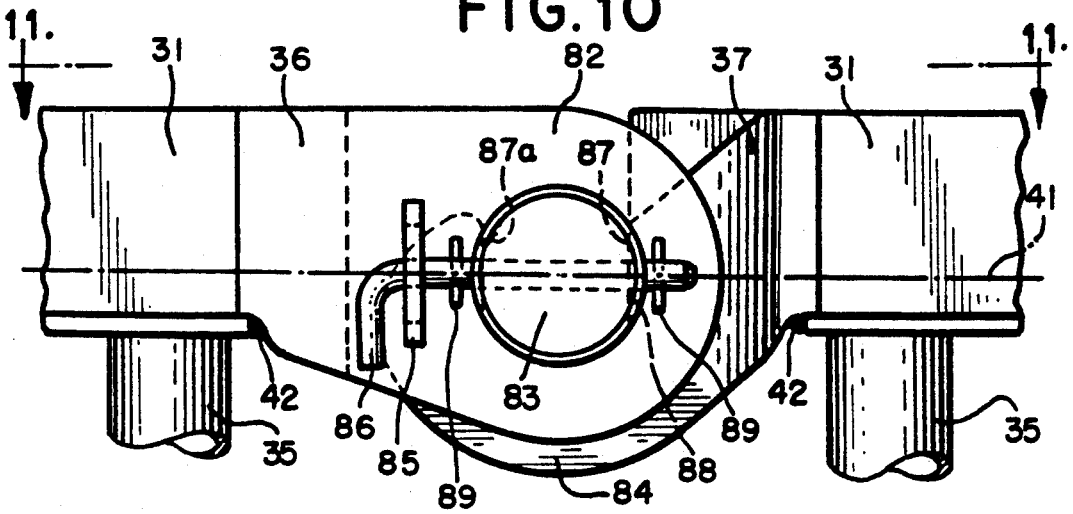
FIG. 11
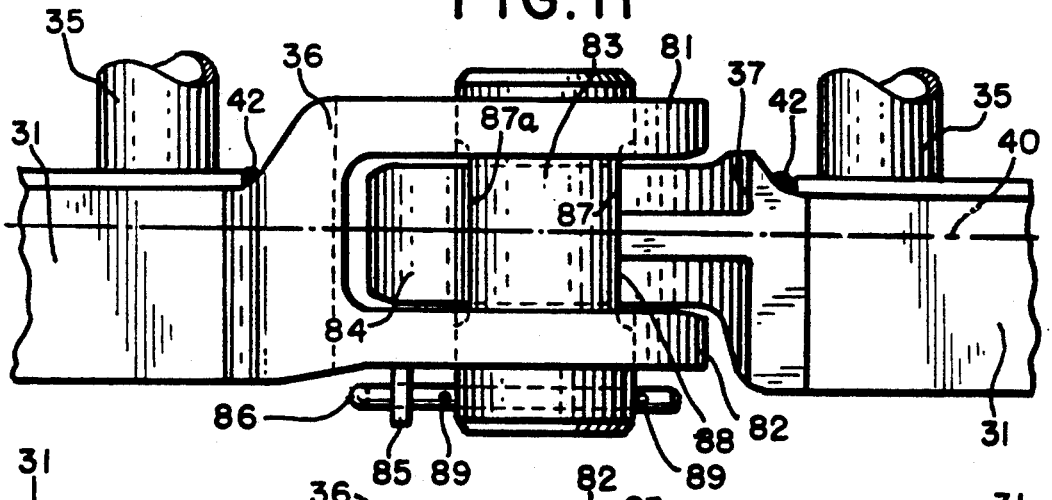
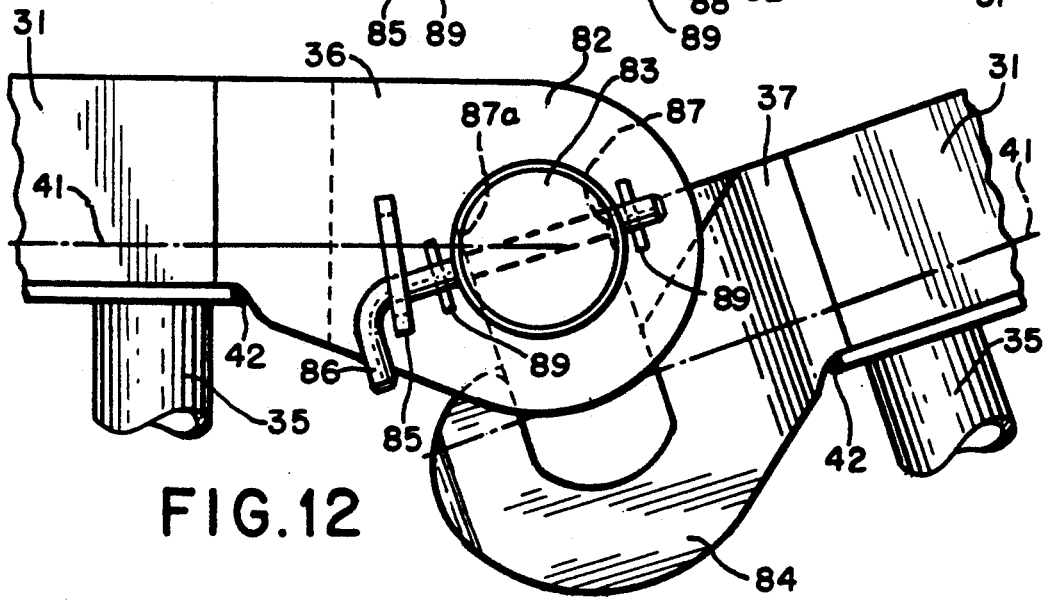
FIG. 12

QUICK-CONNECT SECTIONAL BOOM MEMBERS FOR CRANES AND THE LIKE

BACKGROUND OF THE INVENTION

The present invention relates to lift cranes, and more particularly to quick-connect systems for sectional boom members for cranes and the like.

Large capacity lift cranes typically have elongate load supporting boom structures comprised of sectional boom members secured in end-to-end abutting relationship. Predominantly, each of the sectional boom members is made of a plurality of generally axially extending chords interconnected by diagonally disposed lacing or lattice elements. The terminal end portions of each chord are generally provided with connectors of one form or another to secure abutting boom segments together and to carry compressive loads between abutting chords. Typical connectors comprise male and female lugs secured by a pin carrying compressive loads in double shear.

An example 220 foot boom may be made of a 40 foot boom butt pivotally mounted to the crane upper works, a 30 foot boom top equipped with sheaves and rigging for lifting and supporting loads, with five sectional boom members in between: one 10 feet in length, one 20 feet in length and three 40 feet in length. Such an example boom has six boom section connections. Typically each section has four chords, and hence four connectors, making a total of 24 connectors that must be aligned and pinned to assemble the boom.

Large capacity cranes require very large boom cross sections. As a result, even when the boom segments are laying flat on the ground, the pin connectors between the top chords are typically eight feet or higher off the ground. The rigging personnel must either move a step ladder to each pin location or stand and walk along the top of the boom to reach the top connectors.

A 40 foot long sectional boom member may weigh over 5,000 lbs. Thus, an assist crane is required to lift the boom member. One rigger usually then holds the suspended boom section in general alignment while a second rigger uses a large hammer (10 or 15 lbs.) to manually drive the pin, which typically has a long taper, into position. In the prior art, the pins connecting the boom sections are generally used to carry the compressive loads between chords. As a result, the pins have a tight fit, further increasing the difficulty in assembling the boom. As such, it may take three men (a crane operator and two riggers) four or more hours to assemble the example 220 foot boom. Where the crane is moved frequently, the costs to assemble and disassemble the boom may exceed the cost to lift and position the load for which the crane is used.

Efforts have been made to design sectional boom members with quick-connect systems. For example, U.S. Pat. No. 3,511,388 discloses a pin connection system for boom structures having tubular chord members. Tapered male lug members are disclosed for insertion, presumably with some rapidity, into female sockets. The lugs are then held together by a pin. Compressive loads are carried by machined surfaces on the perimeter of the lugs, slightly larger in width than thickness of the walls of the tubular members.

German Patent Publication No. DE 3842726 A1 apparently discloses a quick-connect system where the connectors on the top chords have hook-like male lugs and female lugs with spaced members capturing a horizontal pin between them. FIG. 10 apparently shows how the hook-shaped member can be fit in place while the boom sections are not parallel, with a rotary motion (about the axis of the pins) bringing the boom sections into parallel alignment and apparently mating up bearing surfaces on the end of each male lug with the inner face of each female lug. Apparently the horizontal neutral axis of the top chords (which appear to be tubular in cross-section) intersect the centerline of the pin, but does not intersect the compressive load bearing surface.

It would be preferable if compressive load bearing surfaces on connectors were intersected by the line formed by the intersection of the horizontal and vertical neutral axes of the chords to which they were attached, and most preferably be symmetrical about these axes. This would allow compressive loads to be transmitted through the connectors without creating bending moments in the chords. Also, chords having a right angle cross-section are frequently used on boom sections, and quick-connect systems for such chords would be useful.

SUMMARY OF THE INVENTION

Quick-connect sectional boom members and quick-connect systems for sectional boom members for cranes and the like have been developed which provide these desired features, as well as many others.

One aspect of the invention is a quick-connect system for a sectional lattice boom wherein each boom section comprises chords for carrying compressive loads and connectors secured to the ends of the chords and between abutting ends of chords of adjacent boom sections, each connector comprising a compressive load bearing surface, the connectors being configured and attached to the chords such that the compressive load bearing surface of each connector is intersected by a line extending along the intersection of the vertical and horizontal neutral axes of the chord member to which the connector is attached.

In another aspect of the invention, a quick-connect sectional boom member comprises at least three chords with intermediate lacing elements, each of the chords having an end configured to abut a corresponding end of a chord of a second sectional boom member to which the first sectional boom member is adapted to connect. Connectors attached to the ends of the chords are used to connect with mating connectors on abutting ends of the chords of the second sectional boom member. The connectors comprise a load bearing surface for transmitting compressive loads between abutting chords. At least one of the connectors is configured such that a mating connector can be easily aligned with it when the two boom sections are being connected. The easily alignable connector has the load bearing surface positioned so as to be intersected by a line extending along the intersection of the horizontal and vertical neutral axes of the chord to which the connector is attached.

The benefit of the invention is that compressive loads are carried through the connector on bearing surfaces which are intersected by the horizontal and vertical neutral axes of the chords. In this manner the chord's compressive loads do not induce bending moments.

Using the quick-connect features of the invention, a sectional boom can be quickly assembled that has superior load bearing attributes. Further, the embodiments of the invention disclosed hereafter each allow rotational engagement of boom sections. That is, the top chords are easily connected by bringing a second sectional boom member into a non-parallel relationship to a first sectional boom member and hooking the top chord connectors of the second boom section into the connectors of the first boom section. As the unattached end of the second boom section is lowered to align the sectional boom members, the bottom chord connectors naturally swing into the proper alignment position. The bearing surfaces on the bottom chord connectors also provide stop-surfaces to prevent further rotation of the second boom section, leaving the connectors aligned so that they can be easily pinned. Less time and manpower are thus required to assemble the boom.

These and other advantages of the invention, as well as the invention itself, will best be understood in view of the drawings, a brief description of which is as follows.

BRIEF DESCRIPTION OF THE DRAWINGS

FIG. 3 is an enlarged, partially sectional, side elevational view of one of the top chord connections depicted in FIG. 2.

FIG. 4 is a top plan view taken along line 4—4 of FIG. 3.

FIG. 5 is an enlarged, partially sectional, side elevational view, similar to FIG. 3, of a second embodiment of a top chord connection of the present invention.

FIG. 6 is a top plan view taken along line 6—6 of FIG. 5.

FIG. 10 is an enlarged, side elevational view, similar to FIG. 3, of a fourth embodiment of a top chord connector of the present invention.

FIG. 11 is a top plan view taken along line 11—11 of FIG. 10.

FIG. 12 is a view of the embodiment of FIG. 10 shown in a partially engaged position.

DETAILED DESCRIPTION OF THE PRESENTLY PREFERRED EMBODIMENTS

For ease of reference, designation of "top", "bottom", "horizontal" and "vertical" are used herein and in the claims to refer to portions of a sectional boom in a position in which it would typically be assembled on or near the surface of the ground. These designations still apply although the boom may raised to different angles, including a vertical position.

Figure 1:
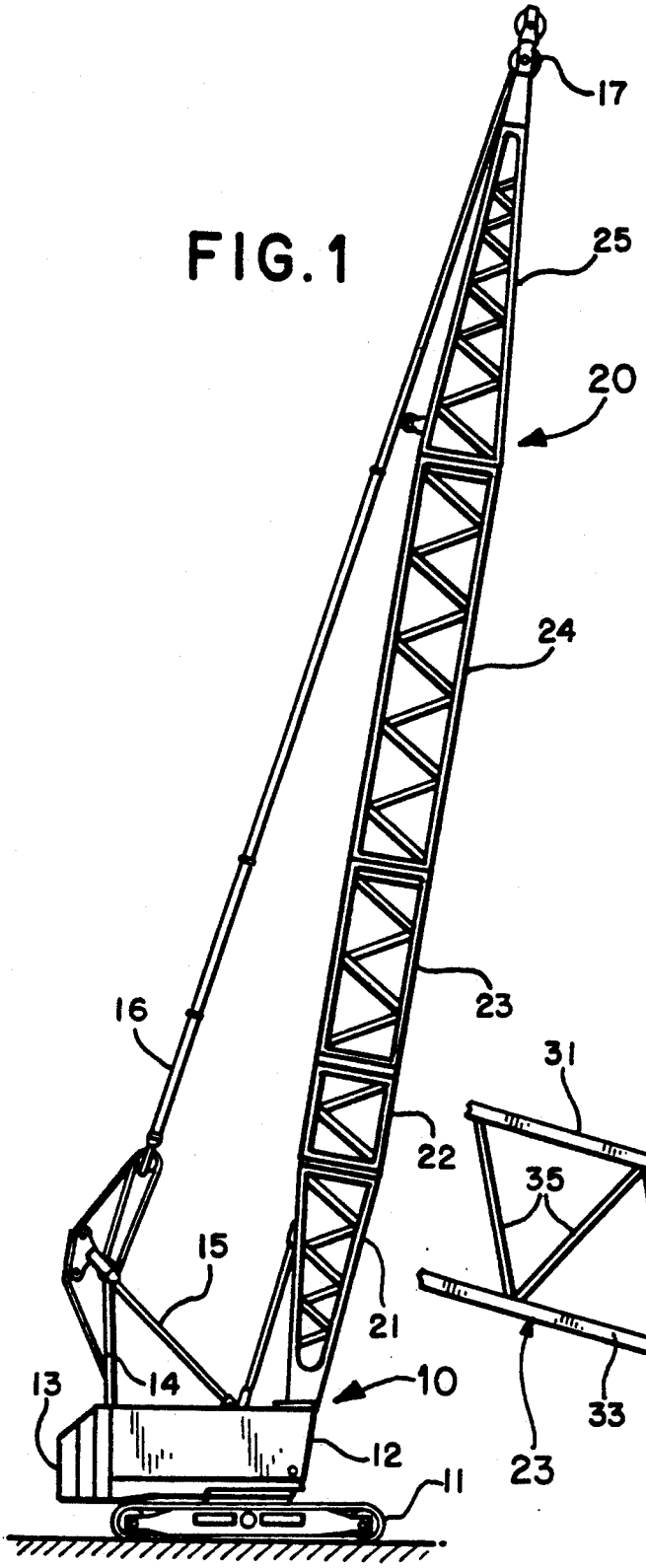
FIG. 1 is a side view of a typical crane with a lattice sectional boom construction to which the present invention may be applied.

The typical crane 10, as shown in FIG. 1, is comprised of upper works 12 rotatably mounted on lower works 11 which, as shown, may include self propelled crawler tracks. The upper works 12 typically has a counterweight 13 attached thereto and supports a back hitch 14 and mast or gantry 15, as well as a pivotally mounted boom 20. A sheave assembly 17 at the top of the boom 20 is used to hoist loads from the boom. Live rigging or a pendant 16 connects the top of the boom 20 to the gantry 15 and is used to adjust the boom angle.

Figure 2A:
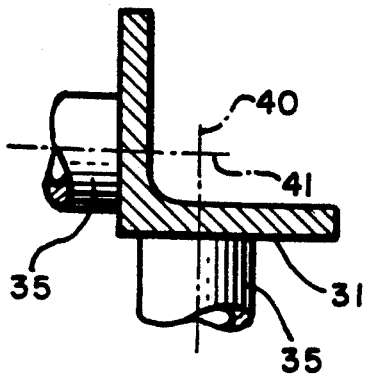
FIG. 2A is a cross sectional view of one of the top chords of the boom section taken along line 2A—2A of FIG. 2.
Figure 2:
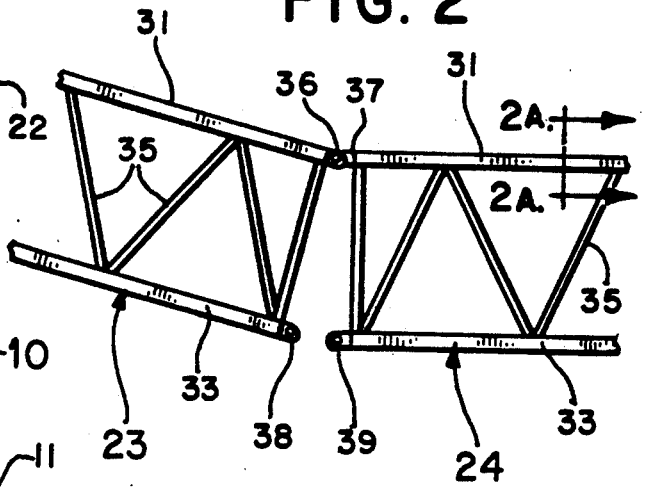
FIG. 2 is a side elevational view of a first embodiment of a quick-connect system of the present invention showing two boom sections during rotational engagement of the sections.

In conventional cranes, the boom 20 is made of several sectional members, including a boom butt 21, boom insert sections 22, 23 and 24, which may vary in number and be of different lengths, and a boom top 25. The sectional boom members 21-25 typically are comprised of multiple chords. In the embodiment shown in FIG. 2, each boom section 23 and 24 has a rectangular cross section with a chord at each corner. Thus there are two top chords 31 and two bottom chords 33 (only one of each of which can be seen in the side view) interconnected by lacing on lattice elements 35. In the embodiments shown, the chord members are made of steel with a right angle cross section, as shown in FIG. 2A. Each chord member has a vertical neutral axis 40 and a horizontal neutral axis 41. Compressive loads applied at the intersection of the vertical and horizontal neutral axes of a chord will not induce bending moments within the chord. In the preferred embodiments, the lattice elements 35 are welded to the chords such that the centerline of the lattice element 35 is as near as possible to the neutral axis intersecting the face of the chord to which the lattice element 35 is welded.

Described hereafter are six embodiments of easily alignable connectors. The easily alignable connectors are described as being provided on the top chords 31 of a boom section. Also, two embodiments of connectors for bottom chords 33 are disclosed. Each embodiment includes mating connectors, attached to abutting ends of the chord of the sectional boom members. The mating connectors generally have a male and female relationship. Thus there are two top chord female connectors 36 and two bottom chord female connectors 38 on each boom section, generally but not necessarily on the same end of the boom section, as well as two top chord male connectors 37 and two bottom chord male connectors 39 an opposite ends of the boom section from the respective top and bottom chord female connectors. Thus when two boom sections such as sections 23 and 24 are brought together for assembly, the two top chord female connectors 36 of section 23 mate with the top chord male connectors 37 of section 24, and the bottom chord female connectors 38 of section 23 mate with the bottom chord male connectors 39 of section 24. The foregoing reference numbers are used for the various embodiments disclosed in FIGS. 3–21.

In the embodiment of the easily alignable connector shown in FIGS. 3 and 4, the female connector 36 comprises a lug with two spaced members 51 and 52 extending parallel with chord 31. The lug is welded to the end of chord 31 with groove welds 42, as are all the lugs shown in FIGS. 3–21. A horizontal pin 53 spans between spaced members 51 and 52. A shoulder 55 built up on spaced member 51 holds a cotter pin 56 used to secure pin 53.

The male connector 37 comprises a hook-shaped member 54 adapted to fit between the spaced members 51 and 52 and engage pin 53. When the boom sections are in operational position, compressive loads are carried by the pin 53 in double shear. The bearing surface for those loads is on the right hand side (as shown in FIG. 3) of pin 53 at contact area 58. It will be noted that contact area 58 is intersected by both the vertical and horizontal neutral axes 40 and 41 of chords 31.

FIGS. 5 and 6 show a second embodiment of the invention, improved over the first embodiment in that the load bearing surface is enlarged and not carried on a radiused surface. In this embodiment female connector 36 again comprises a lug with two spaced members 61 and 62 extending parallel to chord 31. Horizontal pin 63 spans between the spaced members 61 and 62, and is held in place by a cotter pin 66 through a shoulder 65 built up on spaced member 61. The pin 63 carries a hex bushing 67. The hook shaped member 64 on male lug or connector 37 is adapted to fit between the spaced members 61 and 62, and the hook is shaped to mate with four sides of the bushing 67. The compressive loads are carried by surface 68 which is the face of the bushing 67 facing the end of the chord 3 carrying the male lug or connector 37. Again, surface 68 is intersected by both the vertical and neutral axes 40 and 41 of chords 31, and is symmetrical about both axes 40 and 41. In this fashion, the surface 68 is centered about (meaning the centroid of the surface 68 is intersected by) the line containing the intersection of axes 40 and 41.

Figure 7:
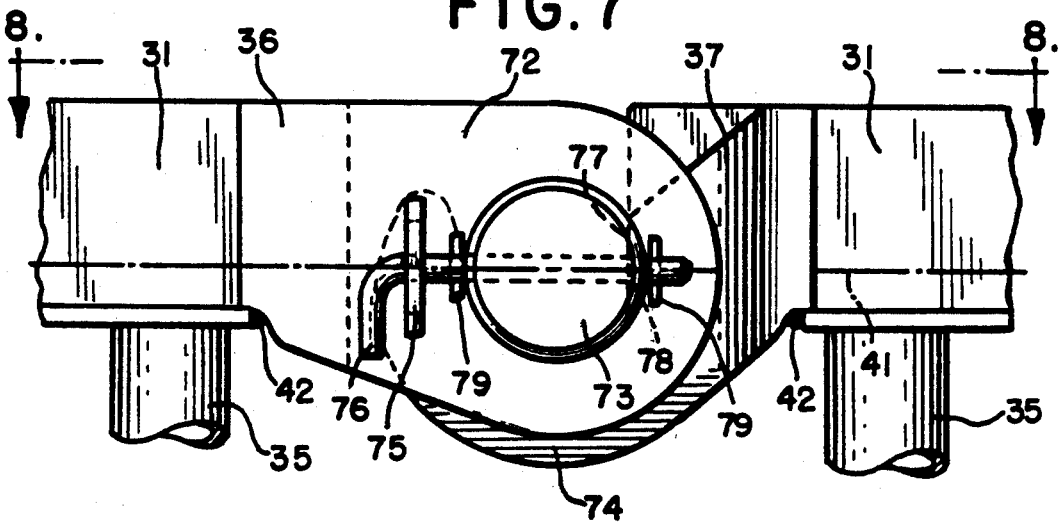
FIG. 7 is an enlarged, side elevational view, similar to FIG. 3, of a third embodiment of a top chord connection of the present invention.
Figure 8:
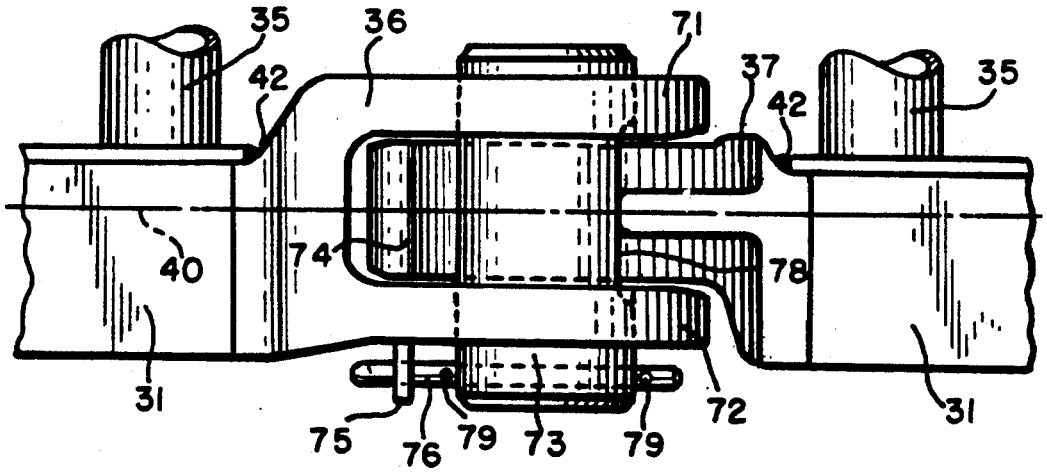
FIG. 8 is a top plan view taken along line 8—8 of FIG. 7.
Figure 9:
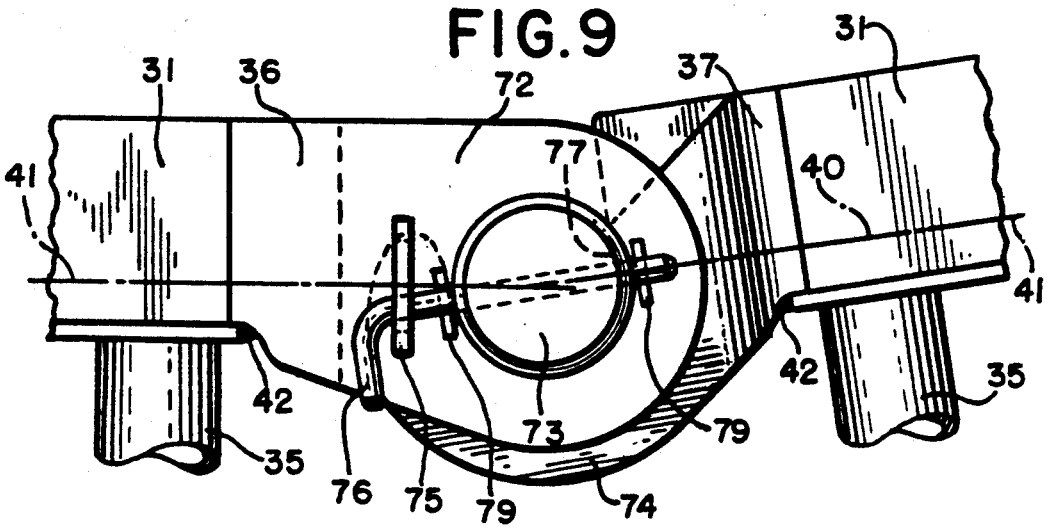
FIG. 9 is a view of the embodiment of FIG. 7 shown in a partially engaged position.

A third embodiment of the invention is shown in FIGS. 7–9. Again the female lug or connector 36 comprises two spaced members 71 and 72 extending parallel to chord 31, with a horizontal pin 73 spanning between the spaced members 71 and 72. In this embodiment, the pin 73 is rotatable about its central axis. The pin 73 is generally cylindrical but includes one flattened face 77 parallel to its central axis. The hook shaped member 74 is adapted to fit between spaced members 71 and 72 and engage the flattened pin 73.

The female lug or connector 36 also comprises a means for the limiting the degree of rotation of the pin 73 about its central axis. In the disclosed embodiment, a keeper pin 76, held in pin 73 by cotter pins 79, is also captured in a slotted tab 75 extending outwardly from, spaced member 72. The length of the slot in tab 75 thus controls the degree of rotational freedom of pin 73. As shown in FIG. 9, when the connectors 36 and 37 are first engaged, the pin 73 is rotated so that its flattened face 77 allows the hook shaped member 74, attached to a boom section which is not parallel with the boom section to which female connector 36 is attached, to slide into engagement. Rotation of the two boom sections about the axis of pin 73, and rotation of pin 73, then allows the chords 31 to come into an end-to-end relationship as shown in FIG. 7.

The compressive loads between chords is carried by load bearing surface 78, which is on the flattened face 77 of pin 73 and the mating face of the hook shaped member 74. Again this load bearing surface is centered about the intersection of is intersected by and is symmetrical about both the vertical and neutral axes 40 and 41 of chords 31.

A fourth embodiment of an easily alignable connector of the present invention, shown in FIGS. 10–12, is very similar to the third embodiment, and the same reference numbers increased by 10 are therefore used on the drawings. In this embodiment, the pin 83 has two flattened faces 87 and 87*a*, parallel to each other. The same relationship of the neutral axes 40 and 41 applies to bearing surface 88 as for bearing surface 78.

Figure 13:
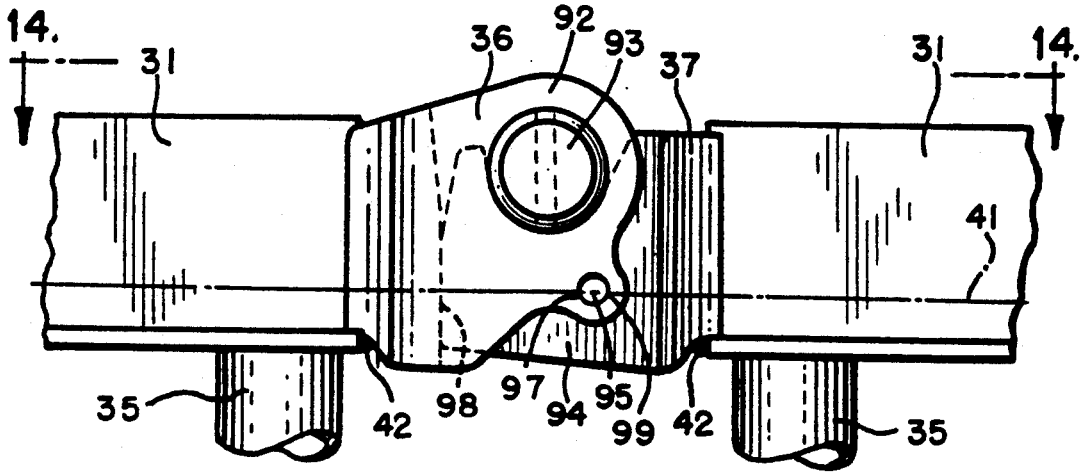
FIG. 13 is an enlarged, side elevational view, similar to FIG. 3, of a fifth embodiment of a top chord connector of the present invention.
Figure 14:
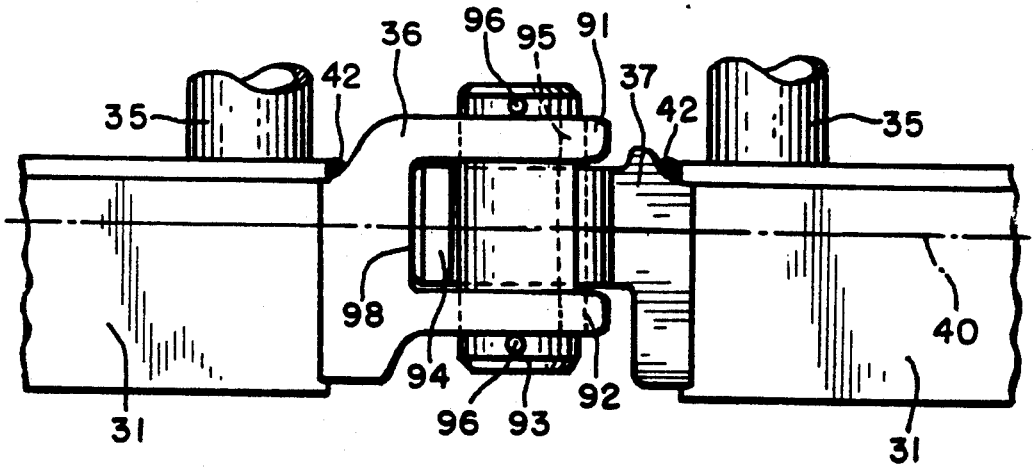
FIG. 14 is a top plan view taken along line 14—14 of FIG. 13.
Figure 15:
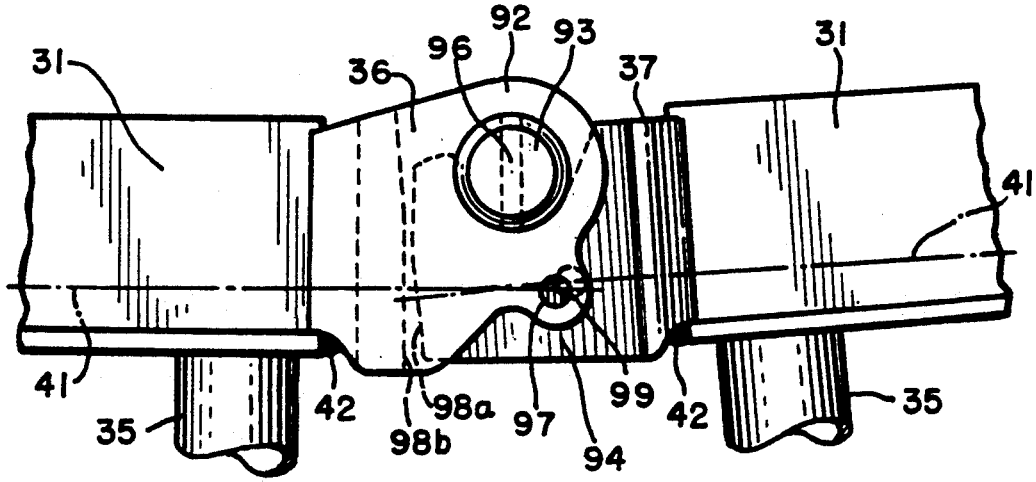
FIG. 15 is a view of the embodiment of FIG. 13 shown in a partially engaged position.

A fifth embodiment of the easily alignable connection of the present invention is shown in FIGS. 13–15. The female lug or connector 36 again comprises two spaced members 91 and 92 extending parallel to chord 31 to which lug or connector 36 is attached, and a horizontal pin 93 spanning between the spaced members 91 and 92. Cotter pins 96 keeps the pin 93 from shifting longitudinally. However, in this fifth embodiment the pin 93 is positioned such that its centerline is above the horizontal neutral axis 41 of chord 31. The female lug or connector 36 also comprises a bearing surface 98*b* for carrying compressive loads between the abutting chords 31. This bearing surface is between the spaced members 91 and 92, and is centered about the intersection of, is intersected by and is symmetrical about both the vertical and horizontal neutral axes 40 and 41 of chord 31.

The male lug or connector 37 secured to the end of chord 31 on a second sectional boom member abutting chord 31 carrying female lug or connector 36 comprises a hooked shape member 94. The hook is shaped to mate with pin 93, and the hook terminates in a bearing surface 98*a* positioned to engage bearing surface 98*b* when the sectional boom members are brought into operational alignment.

By having the pin 93 positioned above the horizontal neutral axis 41, the connectors can be engaged through a rotary engagement about pin 93 and still have a load bearing surface 98 intersected by the intersection of the vertical and horizontal neutral axes 40 and 41.

To prevent the connectors from becoming disengaged, a locking pin 95 is inserted through holes 97 through spaced members 91 and 92 and hole 99 through hook shaped member 94. The holes 97 and 99 are aligned when the connectors 36 and 37 are fully engaged.

Figure 16:
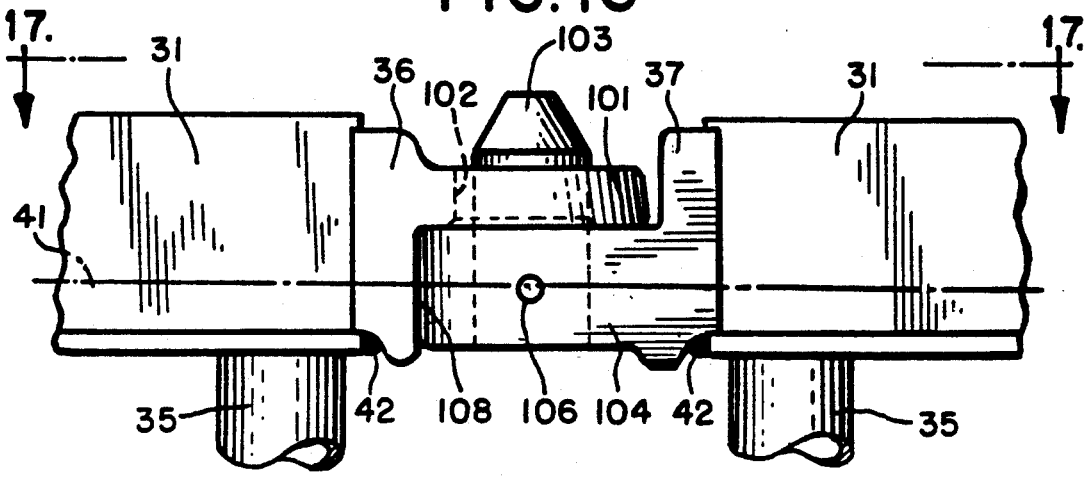
FIG. 16 is an enlarged, side elevational view, similar to FIG. 3, of a sixth embodiment of a top chord connector of the present invention.
Figure 17:
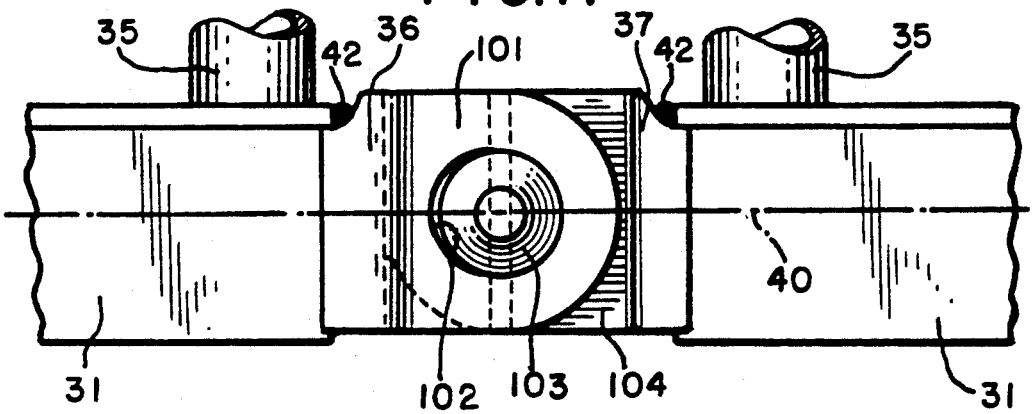
FIG. 17 is a top plan view taken along line 17—17 of FIG. 16.
Figure 18:
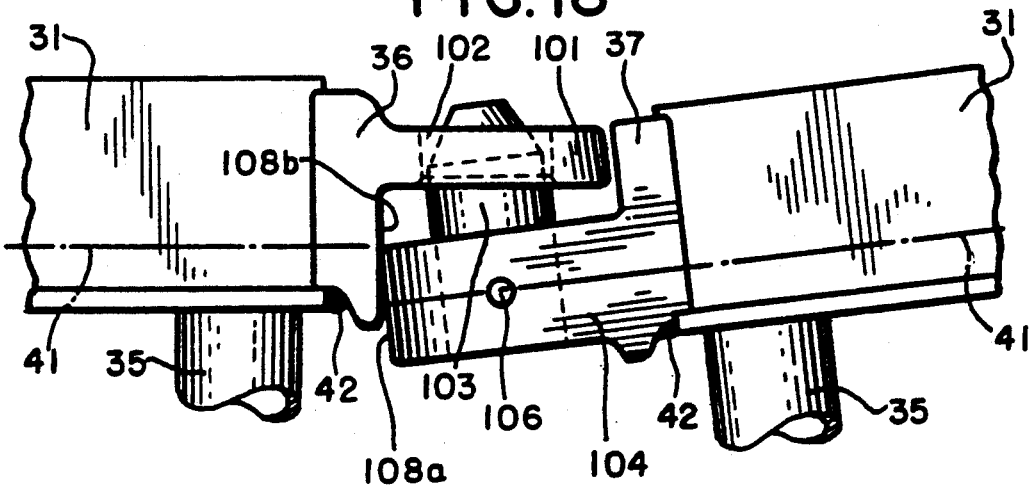
FIG. 18 is a view of the embodiment of FIG. 16 shown in a partially engaged position.

The sixth and most preferred embodiment of the easily alignable connection of the present invention is shown in FIGS. 16–18. In this embodiment the quick connect system comprises a male connector 37 having a lug 104 carrying a vertical pin 103. In the preferred embodiment, the pin 103 extends into or through the body of lug 104 and is held in place by a keeper pin 106. Also the pin 103 is preferably tapered at its top end. On the end of chord 31 abutting the chord 31 carrying lug 104 is a female connector 36 comprising lug 101. Lug 101 is a generally horizontally extending element with an elongated hole 102 therethrough. The location and size of pin 103 and hole 102 are such that the lug 101 and 104 may be interconnected through rotational engagement about a horizontal axis perpendicular to the length of the boom, as shown in FIG. 18.

The horizontally extending portion of lug 104 is fashioned on its end face with a bearing surface 108*a* for carrying compressive loads between abutting chords 31. Likewise, lug 101 comprises a bearing surface 108*b* positioned to mate with bearing surface 108*a* when the sectional boom members are in operational engagement. The bearing surfaces 108*a* and 108*b* are each centered about the intersection of, are intersected by and symmetrical about the vertical and horizontal neutral axes 40 and 41 of chords 31.

Preferably the elongated hole 102 has a narrow dimension only slightly greater than the diameter of the pin 103. This allows transverse loads created on the boom 20 to be transmitted between the pin 103 and side wall of the hole 102 as a shear force across the pin 103 at the horizontal interface of the two lugs 103 and 104.

Figure 19:
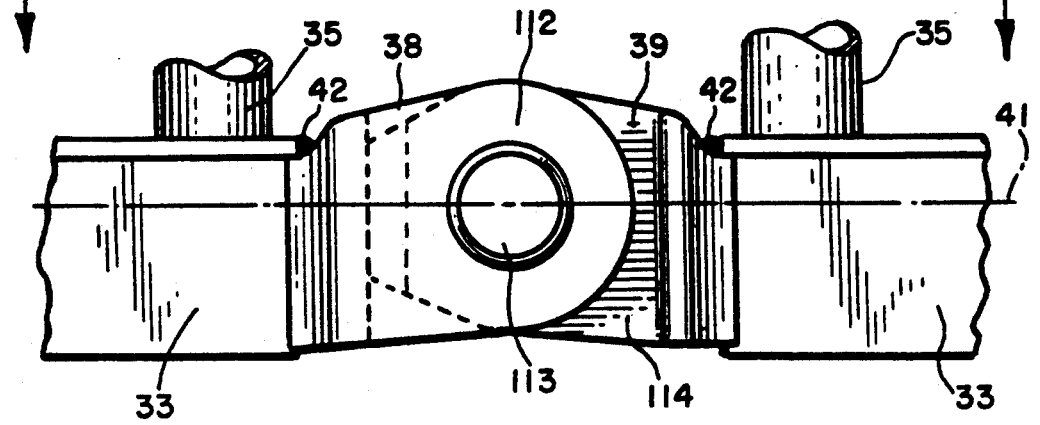
FIG. 19 is an enlarged, side elevational view of a first embodiment of a bottom chord connection of the present invention.
Figure 20:
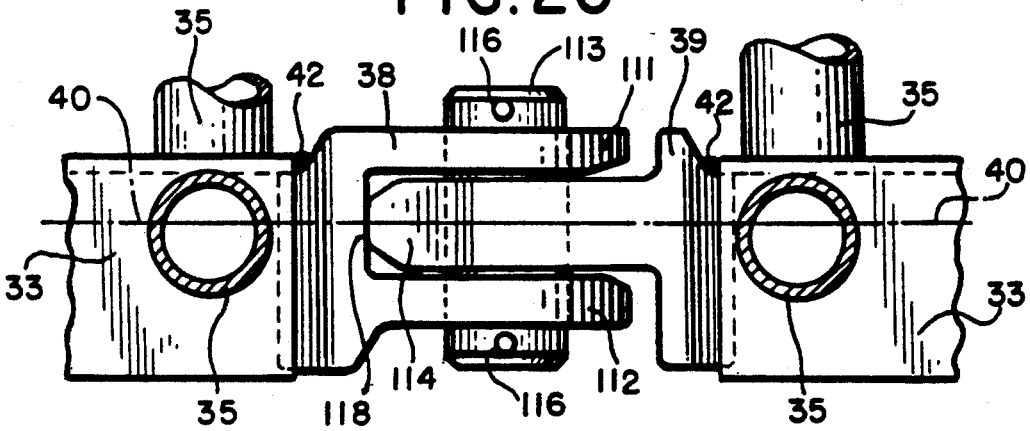
FIG. 20 is a top sectional view taken along line 20—20 of FIG. 19.

FIGS. 19 and 20 shows a first embodiment of a bottom chord connection for the quick-connect system of the present invention. The female connector 38 comprises two spaced members 111 and 112 extending generally parallel to the chord 33. The male connector 39 comprises one extending lug 114. Each of the spaced members 111 and 112 and the lug 114 include a hole through which a pin 113 can be inserted after the boom sections are aligned. Once in place, the pin 113 may be held by cotter pins 116.

As best seen in FIG. 20, male lug 114 includes a load bearing surface 118. This bearing surface bears against a load bearing surface formed on the inside area of connector 38 between the spaced members 111 and 112. As mentioned previously, these load bearing surfaces also provide a stop surface to limit rotation of the sectional boom members about the easily alignable connections between the top chords. Also, these load bearing surfaces are centered about the intersection of, are intersected by and are symmetrical about the vertical and horizontal neutral axes 40 and 41 of the chords 33.

Figure 21:
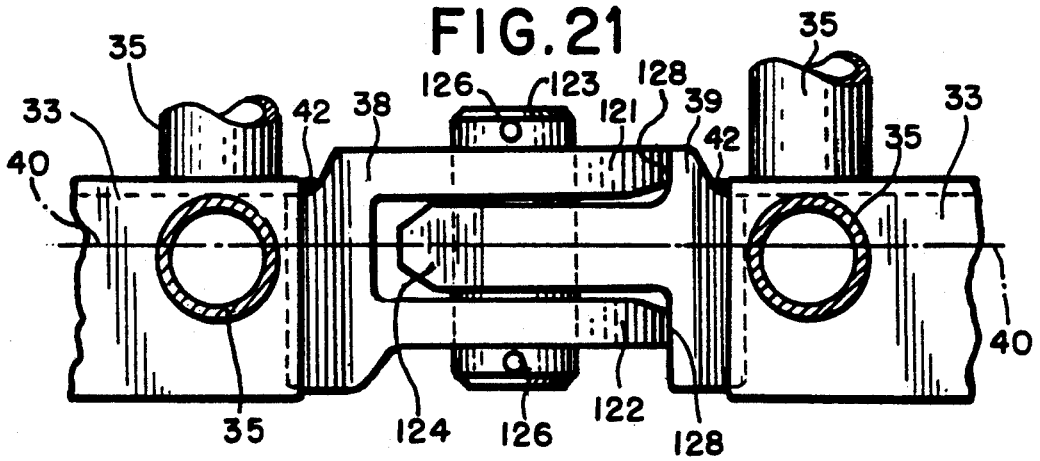
FIG. 21 is a top sectional view, similar to FIG. 20, of a second embodiment of a bottom chord connection of the present invention.

A second embodiment of a connector for the bottom chords is shown in FIG. 21. This arrangement is similar to the first embodiment except that the bearing surfaces 128 are formed on the ends of the spaced members 121 and 122 making up the female connector 38 and the base of the male connector 39. The lug 124 of the male connector 39 thus does not extend to the inside surface of the female connector 38 between the spaced members 121 and 122. Again, the load bearing surfaces 128 also provide stop surfaces, leaving the holes through the spaced members 121 and 122 and male lug 124 aligned for insertion of pin 123.In this embodiment, the bearing surfaces 128 are not intersected by the vertical neutral axis 40, but are intersected by the horizontal neutral axis 41 (not shown) and are symmetrical about both neutral axes. Also, the centroid of the area of bearing surfaces 128 is intersected by the intersection of axes 40 and 41. Either of the two bottom chord connectors may be used with any of the six top chord connectors to provide different quick-connect systems of the present invention. Also, modified bottom connectors may be used where the loads are still carried by the connecting pins, but having stop surfaces similar to surfaces 118 and 128. In these modified embodiments (which may be easier to fabricate since it is easier to maintain tolerances between a pin and a hole than between the required tolerances in positioning load bearing surfaces 118 and 128), the stop surfaces would be set back about 0.015" so that when the pins were driven in there would be a slight gap at the stop surfaces.

With the use of either of the two bottom chord connector embodiments and one of the six top chord connectors, torsional loading on the boom is carried through both bottom chord connections and at least one of the top connectors, depending on which direction the torsional loading is applied.

The various pins, lugs and chord members are preferably made of steel, sized in accordance with standard engineering design practice. The lugs may be constructed from welded plate material, or more preferably from castings.

In the fifth embodiment (FIG. 13), the hook is preferably shaped to have an opening wider than the pin diameter, narrowing so that the bottom portion of the hook has the same radius as the pin. In this embodiment, the pin carries very little of the load bearing forces, but does carry any separating forces generated when torsional loads are created in the boom (such as by swing operations). The locking pin shown in FIGS. 13–15 is optional since the bottom chord connections, once made, will prevent the pin and hook from disengaging.

Each of the six easily alignable connectors shown allows for rotary engagement. During assembly, a suspended boom section is guided into general engagement by one rigger from ground level. The assist crane operator lowers the hoist line, allowing the unengaged end of the suspended boom section to drop, rotating the bottom connector into place. The rigger may then install the ground level bottom pins. Since the compressive loads are carried by the surfaces 118 or 128, the pins 113 or 123 do not require a tight fit. Further, alignment of the holes for the pin is mechanically assured.

The sixth embodiment has several distinct benefits. First, the upper connector is tightly captured longitudinally between the vertical pin and the bearing surface. The final portion of the rotary engagement produces a tight fit with no alignment effort. Second, engagement of both the horizontal and vertical bearing surfaces is readily visible. Third, coupled forces on the chords resulting from moments created from crane swing (especially in tower cranes) will not be able to separate the connectors, since the vertical pin carries the load in single shear. In the sixth embodiment, both top chord connectors act to carry torsional loads. As with other embodiments, the chord compressive load is carried through the connector bearing surfaces with no induced bending moments since the surfaces are centered about and intersected by the intersection of the vertical and horizontal neutral axes.

Even though preferred embodiments use chords having a right angle cross section, other chord cross sections can be made using the invention by welding endplates on the chords and positioning the connectors such that the proper relationship is achieved between the bearing surfaces and the neutral axes of the chords.

It should be appreciated that the apparatus of the present invention is capable of being incorporated in the form of a variety of embodiments, only a few of which have been illustrated and described above. The invention may be embodied in other forms without departing from its spirit or essential characteristics. For example, the invention could be applied to triangular cross sectional boom members having only three chords, with either one or two of the chords having easily-alignable connectors. While male and female lug designs are shown, other lug arrangements are possible. For example, the pin in the first five embodiments could be carried by a male member while spaced members of the female lug are hook shaped. Also, triple female pin carrying members and double male hook arrangements could be used.

For these reasons, the described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. A quick-connect sectional boom member for cranes and the like, the sectional boom member comprising:

a) at least three chords with intermediate lacing elements, each of the chords having an end configured to abut a corresponding end of a chord of a second sectional boom member to which said first sectional boom member is adapted to connect, b) a connector attached to said end of each chord for connecting with a mating connector on each of the abutting ends of the chords of said second sectional boom member, c) said connectors each comprising a load bearing surface for transmitting compressive loads between abutting chords, and d) at least one of said connectors comprising a first connector comprising a lug having a vertically protruding pin extending therefrom.

2. The quick-connect sectional boom member of claim 1 wherein a second connector also comprises a lug having a vertically protruding pin extending therefrom and the bearing surface on each of said first and second connectors is positioned so as to be intersected by the intersection of the horizontal and vertical neutral axes of the chord member to which it is attached.

3. The quick-connect sectional boom member of claim 1 wherein the first connector is configured such that an adjoining connector may be attached through rotational engagement of the second sectional boom member.

4. The quick-connect sectional boom member of claim 1 having a connector on an opposite end of the chord to which said at least first connector is attached comprising a lug with a hole therethrough designed to fit over a vertically protruding pin on a lug of a connector on said second sectional boom member shaped like said first connector.

5. The quick-connect sectional boom member of claim 4 wherein the hole is elongated in a direction parallel to the neutral axis of the chord to which it is attached to facilitate rotary engagement of the connectors during connection of said first sectional boom members with said second sectional boom member.

6. The quick-connect sectional boom member of claim 1 wherein the lug on said first connector comprises a bearing surface on an end furthest from the chord to which the lug is connected, and said bearing surface is adapted to mate with a bearing surface on a lug of a mating connector having a hole therethrough for receiving said pin.

7. A quick-connect sectional boom member for cranes and the like, the sectional boom member comprising:

a) at least three chords with intermediate lacing elements, each of the chords having an end configured to abut a corresponding end of a chord of a second sectional boom member to which said first sectional boom member is adapted to connect, b) a connector attached to said end of each chord for connecting with a mating connector on each of the abutting ends of the chords of said second sectional boom member, c) said connectors comprising a load bearing surface for transmitting compressive loads between abutting chords, and d) said connectors comprising a first connector on one end of the sectional boom member and a second connector on an opposite end of the chord to which said first connector is attached, said first connector comprising a female lug comprising two spaced members extending parallel to the chord member to which the lug is attached, with a horizontal pin spanning between the spaced members, said second connector comprising a male lug comprising a hook-shaped member adapted to fit between the spaced members of the female lug and engage the pin of a connector configured like said first connector; and e) said first connector having said load bearing surface positioned so as to be intersected by a line extending along the intersection of the horizontal and vertical neutral axes of the chord to which said first connector is attached, with the compressive loads being carried by said pin in double shear.

8. The quick-connect sectional boom member of claim 7 wherein a hex-shaped bushing is carried on the pin.

9. The quick-connect sectional boom member of claim 7 wherein the horizontal pin includes at least one flattened face, and the female lug also comprising means for limiting rotation of the pin.

10. The quick-connect sectional boom member of claim 9 wherein the pin comprises one flattened face.

11. The quick-connect sectional boom member of claim 9 wherein the pin comprises two parallel flattened faces.

12. A quick-connect sectional boom member for cranes and the like, the sectional boom member comprising:

a) at least three chords with intermediate lacing elements, each of the chords having an end configured to abut a corresponding end of a chord of a second sectional boom member to which said first sectional boom member is adapted to connect, b) a connector attached to said end of each chord for connecting with a mating connector on each of the abutting ends of the chords of said second sectional boom member, c) said connectors comprising a load bearing surface for transmitting compressive loads between abutting chords, and d) at least one of said connectors comprising a first connector comprising a female lug comprising i) two spaced members extending parallel to the chord to which the lug is attached, with a horizontal pin spanning between the spaced members, positioned such that the center-line of the pin is not intersected by the horizontal neutral axis of the chord carrying the female lug, and ii) a bearing surface on a portion of the lug parallel to the end of the chord to which the female lug is attached and between the spaced apart members.

13. The quick-connect sectional boom member of claim 12 further including a horizontal hole through the spaced members of the female lug adapted to be aligned with a hole through a hook-shaped member of a male lug on a mating connector for receiving a locking pin once the connectors are in a fully engaged position.

14. A quick-connect system for sectional boom members for cranes and the like wherein the section boom members comprise at least three chords with intermediate lacing elements, each chord terminating in an end configured to abut against an end of a chord of the adjacent sectional boom member, the quick-connect system comprising:

a) a female lug secured to one end of at least one chord of a first sectional boom member, the female lug comprising:
   i) two spaced members extending parallel to the chord member to which the lug is attached,
   ii) a horizontal pin spanning between the spaced members, and
   iii) a hex-shaped bushing carried on the section of the pin between the spaced members; and b) a male lug secured to the end of the chord on a second sectional boom member abutting the chord carrying said female lug, said male lug comprising:
   i) a hook-shaped member adapted to fit between the spaced members of said female lug, the hook being shaped to mate with the hex-shaped bushing such that compressive loads between the chords to which said female and male lugs are connected are carried between engaging faces of said hook-shaped members and said hex-shaped bushing.

15. A quick-connect system for sectional boom members for cranes and the like wherein the sectional boom members comprise at least three chords with intermediate lacing elements, each chord terminating in an end configured to abut against an end of a chord of the adjacent sectional boom member, the quick-connect system comprising:

a) a female lug secured to one end of at least one chord of a first sectional boom member, the female lug comprising:
   i) two spaced members extending parallel to the chord member to which the lug is attached,
   ii) a horizontal pin spanning between the spaced members, and
   iii) the horizontal pin being generally cylindrical but including at least one flattened face parallel to its central axis, the pin being captured by the spaced members so as to be rotatable about its central axis; and b) a male lug secured to the end of the chord on a second sectional boom member abutting the chord carrying said female lug, said male lug comprising:
   i) a hook-shaped member adapted to fit between the spaced members of said female lug, the hook being shaped to engage the flattened pin such that compressive loads between the chords to which said female and male lugs are connected are carried between the at least one flattened face of the pin and mating face of the hook-shaped member.

16. The quick-connect system of claim 15 wherein the pin comprises one flattened face.

17. The quick-connect system of claim 15 wherein the pin comprises two parallel flattened faces.

18. The quick-connect system of claim 15 further comprising means for limiting the degree of rotation of the pin about its central axis.

19. A quick-connect system for sectional boom members for cranes and the like wherein the section boom members comprise at least three chords with intermediate lacing elements, each chord terminating in an end configured to abut against an end of a chord of the adjacent sectional boom member, the quick-connect system comprising:

a) a female lug secured to one end of at least one chord of a first sectional boom member, the female lug comprising:
   i) two spaced members extending parallel to the chord member to which the lug is attached,
   ii) a horizontal pin spanning between the spaced members, and
   iii) a bearing surface for carrying compressive loads between abutting chords, the bearing surface being centered about the intersection of the vertical and horizontal neutral axes of the chord to which the female lug is secured; and b) a male lug secured to the end of the chord on a second sectional boom member abutting the chord carrying said female lug, said male lug comprising:
   i) a hook-shaped member adapted to fit between the spaced members of said female lug, the hook being shaped to mate with the pin, and the hook terminating in a bearing surface positioned to engage the bearing surface of the female lug when the sectional boom members are in operational alignment.

20. The quick-connect system of claim 19 wherein the center-line of the pin is positioned above the horizontal neutral axis of the chord to which the female lug is attached.

21. The quick-connect system of claim 19 further comprising a locking pin through aligned holes through the spaced members on the female lug and the hook-shaped member on the male lug when the sectional boom members are in operational alignment.

22. The quick-connect system of claim 19 wherein the bearing surfaces are intersected by a line containing the intersection of the vertical and horizontal neutral axes of the chord to which the female lug is secured.

23. A quickconnect system for sectional boom members for cranes and the like wherein the sectional boom members comprise at least three chords with intermediate lacing elements, each chord terminating in an end configured to abut against an end of a chord of the adjacent sectional boom member, the quick-connect system comprising:

a) a first lug secured to one end of a first chord of a first sectional boom member, the first lug comprising:
   i) a bearing surface for carrying compressive loads between said first chord and an abutting chord of a second sectional boom member, and
   ii) a vertically extending pin;

b) a second lug secured to the end of said abutting chord abutting said first end, said second lug comprising:
   i) a bearing surface for carrying compressive loads between said first chord and said abutting chord, and
   ii) means for engaging said second lug with the pin of said first lug, said engaging means allowing initial contact between the lugs when the chords are not parallel and rotating engagement about the pin ending in abutment of the bearing surfaces when the chords are parallel, and wherein c) the bearing surfaces are centered about the intersection of the vertical and horizontal neutral axes of the chords to which the lug on which they are formed is secured.

24. The quick-connect system of claim 23 wherein said engaging means comprises a horizontally extending element on said second lug with an elongated hole therethrough, said elongated hole being configured to allow a) insertion of the pin through the hole while the first and second chords are non-parallel, and b) rotational engagement by bringing the first and second chords into an end-to-end relationship.

25. A quick-connect system for sectional boom members for cranes and the like wherein the sectional boom members comprise at least three chords with intermediate lacing elements, each chord terminating in an end configured to abut against an end of a chord of the adjacent sectional boom member, the quick-connect system comprising:

a) a first lug secured to one end of a first chord of a first sectional boom member, the first lug comprising a vertical pin, and b) a second lug secured to the end of a chord on a second sectional boom member abutting said first chord, the second lug comprising a horizontally extending element having an elongated hole therethrough configured to allow said first and second lugs to be interconnected through rotational engagement about a horizontal axis perpendicular to the length of the boom.

26. The quick-connect system of claim 25 wherein a) the first lug comprises i) a horizontally extending element supporting said vertical pin and ii) a bearing surface fashioned on an end face of the pin-supporting, horizontally extending element for carrying compressive loads between said first and second chords, and b) the second lug comprises a bearing surface positioned to mate with the bearing surface on said first lug when the sectional boom members are in operational engagement.

27. The quick-connect system of claim 26 wherein the elongated hole has a narrow dimension slightly greater than the diameter of the pin such that transverse loads created on the boom are transmitted between the pin and the side wall of the hole.

28. The quick-connect system of claim 26 wherein the bearing surfaces on each of the lugs are intersected by a line containing the intersection of the vertical and horizontal neutral axes of the chords to which the lugs are attached.

29. The quick-connect system of claim 28 wherein the bearing surfaces are symmetric about both the horizontal and vertical neutral axes of the chords to which the lugs are attached.

30. The quick-connect system of claim 25 wherein first and second sectional boom members are connected by a shear pin connection between chords other than the chords to which said first and second lugs are secured, and wherein the shear plane of said vertical pin is perpendicular to the shear plane of said shear pin connector.

31. A quick-connect system for a sectional lattice boom wherein each boom section comprises:

a) chords for carrying compressive loads, and b) connectors secured to the ends of the chords and between abutting ends of chords of adjacent boom sections, each connector comprising a compressive load bearing surface, the connectors being configured and attached to the chords such that the compressive load bearing surface of each connector is a flat surface and is intersected by a line extending along the intersection of the vertical and horizontal neutral axes of the chord member to which the connector is attached.

32. The quick-connect system of claim 31 wherein each of the connections between chords of adjacent boom sections include means to oppose torsional forces applied to the boom.

33. The quick-connect system of claim 31 wherein the boom sections each comprise two top chords and two bottom chords, and wherein the connectors between the top chords are configured to allow rotary engagement of adjacent boom sections and the connectors between the bottom chords comprise stop-surfaces to limit the degree of rotation of said rotary engagement, the stop-surfaces also comprising the compressive load bearing surfaces for the connectors.

34. A quick-connect sectional boom member for cranes and the like, the sectional boom member comprising:

a) a connector comprising a lug having a vertically protruding pin; and b) a bearing surface for carrying compressive loads between sectional boom members.

35. The quick-connect sectional boom member of claim 1 wherein the load bearing surface on the at least first connector is positioned so as to be intersected by a line extending along the intersection of the horizontal and vertical neutral axes of the chord to which it is attached.

* * * * *

UNITED STATES PATENT AND TRADEMARK OFFICE

CERTIFICATE OF CORRECTION

PATENT NO. : 5,199,586

DATED : April 6, 1993

INVENTOR(S) : David J. Pech, et. al.

It is certified that error appears in the above-indentified patent and that said Letters Patent is hereby corrected as shown below:

Column 5, line 36, delete "chord 3" and substitute -- chord 31--.
Column 6, line 5, after "of" insert --,--.
Column 11, Claim 14, line 28, delete "members" and substitute --member--.
Column 12, Claim 23, line 1, delete "quickconnect" and subsitute --quick-connect--.

Signed and Sealed this

Twenty-second Day of November, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,199,586

DATED : April 6, 1993

INVENTOR(S) : David J. Pech et al.

It is certified that error appears in the above-indentified patent and that said Letters Patent is hereby corrected as shown below:

ON THE TITLE PAGE

Under the heading "Inventors:", in the fifth line, after "all of" insert --Wisconsin--.

Under the heading "U.S. PATENT DOCUMENTS", after the third line, insert

--2,975,910 3/1961 Conrad . . . . . 212/144--;

after the tenth line, insert

--5,082,128 1/1992 Frazen et al. . . . . 212/266--.

Under the heading "FOREIGN PATENT DOCUMENTS", after the fifth line insert

--2146899 3/1973 France--;

after the seventh line insert

--0376417 7/1990 EPO 585613 3/1977 Switzerland--.

IN THE ABSTRACT

In line 3, delete "comprise" and substitute --include--.

In line 6, delete "comprises" and substitute --includes--.

In line 8, delete "comprising" and substitute --has--.

UNITED STATES PATENT AND TRADEMARK OFFICE

CERTIFICATE OF CORRECTION

PATENT NO. : 5,199,586

DATED : April 6, 1993

INVENTOR(S) : David J. Pech et al.

It is certified that error appears in the above-indentified patent and that said Letters Patent is hereby corrected as shown below:

Column 2, after line 57 insert the following paragraph:

--In another aspect of the invention, a sectional boom member having a longitudinal axis includes longitudinally extending chord members, at least one of the chord members terminating in a connector lug having a pin fixed thereto protruding in a direction transverse to the longitudinal axis of the sectional boom member, which direction is vertical when the boom section is operably connected to the crane and the longitudinal axis of the sectional boom member is horizontal; and a bearing surface on the connector for carrying compressive loads between interconnected sectional boom members.--.

Column 5, line 36, delete "chord 3" and substitute --chord 31--.

Column 6, line 5, after "of" please insert --,--.

Column 9, line 10, delete "and the like".

Column 9, line 60, delete "and the like".

Column 10, line 38, delete "and the like".

Column 11, line 4, delete "and the like".

Column 11, line 28, delete "members" and substitute --member--.

Column 11, line 31, delete "and the like".

UNITED STATES PATENT AND TRADEMARK OFFICE

CERTIFICATE OF CORRECTION

PATENT NO. : 5,199,586

DATED : April 6, 1993

INVENTOR(S) : David J. Pech et al.

It is certified that error appears in the above-indentified patent and that said Letters Patent is hereby corrected as shown below:

Column 11, line 68, delete "and the like".

Column 12, line 41, delete "quickconnect" and substitute --quick-connect--.

Column 12, line 42, delete "and the like".

Column 14, line 39, delete "and the like"; after "member" insert --having a longitudinal axis and--.

Column 14, line 41, before "a connector" insert --longitudinal extending chord members, at least one of the chord members terminating in--.

Column 14, lines 41-42, delete "vertically protruding" and after "pin" insert --fixed thereto protruding in a direction transverse to the longitudinal axis of said sectional boom member, which direction is vertical when the boom section is operably connected to the crane and the longitudinal axis of the sectional boom member is horizontal--.

UNITED STATES PATENT AND TRADEMARK OFFICE

CERTIFICATE OF CORRECTION

PATENT NO. : 5,199,586

DATED : April 6, 1993

INVENTOR(S) : David J. Pech et al.

It is certified that error appears in the above-indentified patent and that said Letters Patent is hereby corrected as shown below:

Column 14, line 43, after "surface" insert --on said connector--.

Column 14, line 44, after "between" insert --interconnected--.

Signed and Sealed this

Twenty-seventh Day of December, 1994

*Attest:*

Bruce Lehman

BRUCE LEHMAN

*Attesting Officer*

*Commissioner of Patents and Trademarks*